US009704434B2

(12) United States Patent
Kang et al.

(10) Patent No.: US 9,704,434 B2
(45) Date of Patent: Jul. 11, 2017

(54) DISPLAY DEVICE AND DRIVING METHOD THEREOF

(71) Applicant: SAMSUNG DISPLAY CO., LTD., Yongin, Gyeonggi-Do (KR)

(72) Inventors: Hyung-Ryul Kang, Seoul (KR); Cheol Min Kim, Seongnam-si (KR); Se-Byung Chae, Seoul (KR)

(73) Assignee: Samsung Display Co., Ltd., Yongin-si (KR)

( * ) Notice: Subject to any disclaimer, the term of this patent is extended or adjusted under 35 U.S.C. 154(b) by 51 days.

(21) Appl. No.: 14/802,945

(22) Filed: Jul. 17, 2015

(65) Prior Publication Data

US 2016/0217739 A1 Jul. 28, 2016

(30) Foreign Application Priority Data

Jan. 22, 2015 (KR) ..... 10-2015-0010840

(51) Int. Cl.
*G09G 5/00* (2006.01)
*G09G 3/3233* (2016.01)

(52) U.S. Cl.
CPC ... *G09G 3/3233* (2013.01); *G09G 2300/0819* (2013.01); *G09G 2300/0852* (2013.01); *G09G 2300/0861* (2013.01); *G09G 2310/0216* (2013.01); *G09G 2320/045* (2013.01)

(58) Field of Classification Search
CPC ..... G09G 3/3258; G09G 2360/08; G09G 2330/028
See application file for complete search history.

(56) References Cited

U.S. PATENT DOCUMENTS

2014/0009456 A1* 1/2014 Kim ..... G09G 3/3208 345/212
2016/0027379 A1* 1/2016 Chen ..... G09G 3/3233 345/698

FOREIGN PATENT DOCUMENTS

KR 10-2007-0120450 A 12/2007
KR 10-2009-0131042 A 12/2009
KR 10-2011-0104414 A 9/2011
KR 10-2011-0104708 A 9/2011

* cited by examiner

*Primary Examiner* — Adam R Giesy
(74) *Attorney, Agent, or Firm* — Lewis Roca Rothgerber Christie LLP

(57) ABSTRACT

A display device includes a plurality of pixel rows including a plurality of pixel circuits; a scan driver supplying scan signals to the plurality of pixel rows; and a data driver supplying a data voltage to the plurality of pixel circuits of the plurality of pixel rows, wherein the plurality of pixel circuits each include driving transistors and an organic light emitting diode which emit light depending on a current flowing in the driving transistors, the plurality of pixel rows are divided into a plurality of blocks, each of the blocks including at least one pixel row, and a period for which the data voltage is written in the plurality of pixel circuits in a first block among the plurality of blocks and a period for which a threshold voltage of the driving transistors of the plurality of pixel circuits in a second block temporally close to the first block is compensated partially overlap each other.

10 Claims, 8 Drawing Sheets

FIG. 7

| SCAN ON TIME | 6.4 | 11.4 | 16.4 |
|---|---|---|---|
| avg | 1.45E-09 | 1.45E-09 | 1.45E-09 |
| std | 1.04E-10 | 7.32E-11 | 6.30E-11 |
| min | 1.15E-09 | 1.24E-09 | 1.28E-09 |
| max | 1.73E-09 | 1.66E-09 | 1.62E-09 |
| MURA | 20% | 14% | 12% |

DISPLAY DEVICE AND DRIVING METHOD THEREOF

CROSS-REFERENCE TO RELATED APPLICATION

This application claims priority to and the benefit of Korean Patent Application No. 10-2015-0010840 filed in the Korean Intellectual Property Office on Jan. 22, 2015, the entire contents of which are incorporated herein by reference.

BACKGROUND

1. Field

Embodiment of the present invention relate to a display device and a driving method thereof, and for example, to a display device including an organic light emitting diode and a driving method thereof.

2. Description of the Related Art

Among the flat panel displays, an organic light emitting diode display applies an electric field to an organic light emitting diode to emit light. The organic light emitting diode display has features in that it has a fast response speed and is driven with low power consumption.

However, a threshold voltage of a driving transistor which drives an organic light emitting diode may be different for each pixel and may be changed over time. When the threshold voltage of the driving transistor is not constant, a current amount which flows in the organic light emitting diode is not constant and thus display non-uniformity may be caused.

Therefore, it is desirable to compensate for the threshold voltage of the driving transistor.

The above information disclosed in this Background section is only for enhancement of understanding of the background of the invention and therefore it may contain information that does not form prior art.

SUMMARY

Embodiments of the present invention may provide a display device and a driving method thereof having features of sufficiently securing a threshold voltage compensation period of a driving transistor in a block driving scheme.

An exemplary embodiment of the present invention provides a display device including: a plurality of pixel rows including a plurality of pixel circuits; a scan driver for supplying scan signals to the plurality of pixel rows; and a data driver for supplying a data voltage or a reference voltage to the plurality of pixel circuits of the plurality of pixel rows, wherein the plurality of pixel circuits each include a driving transistor and an organic light emitting diode configured to emit light depending on a current flowing in the driving transistor, wherein the plurality of pixel rows are divided into a plurality of blocks, each of the blocks including at least one pixel row, and a period for which the data voltage is written in the plurality of pixel circuits in a first block among the plurality of blocks, and wherein a period for which a threshold voltage of the driving transistors of the plurality of pixel circuits in a second block temporally close to the first block is compensated partially overlap each other.

A period for which the data voltage is written in the plurality of pixel circuits in the first block and a period for which the organic light emitting diodes of the plurality of pixel circuits in the second block are initialized may partially overlap each other.

The scan signal may include: a first scan signal applying an initialization voltage to a control terminal of the driving transistor at an ON level and a second scan signal writing the data voltage or the reference voltage to the plurality of pixel circuits at the ON level.

A period for which the data voltage is supplied from the data driver and the second scan signal which is the ON level is applied to the plurality of pixel circuits in the first block may partially overlap a period for which the first scan signal which is the ON level is applied to the plurality of pixel circuits in the second block and not overlap a period for which the second scan signal which is the ON level is applied to the plurality of pixel circuits in the second block.

The scan signal may further include a third scan signal for applying the initialization voltage to an anode of the organic light emitting diode at the ON level.

The period for which the data voltage is supplied from the data driver and the second scan signal which is the ON level is applied to the plurality of pixel circuits in the first block may partially overlap a period for which the third scan signal which is the ON level is applied to the plurality of pixel circuits in the second block.

The plurality of pixel circuits each may further include a first capacitive element having one terminal connected to a first node and an other terminal connected to a second node, a first light emitting control transistor having a control terminal connected to a first light emitting control signal, one electrode terminal connected to the second node, and an other electrode terminal connected to a first power supply, a second light emitting control transistor having a control terminal connected to a second light emitting control signal, one electrode terminal connected to one electrode terminal of the driving transistor, and an other electrode terminal connected to a third node, a third scan transistor having a control terminal connected to a third scan signal, one electrode terminal connected to the third node, and an other electrode terminal connected to the initialization voltage, a first scan transistor having a control terminal connected to the first scan signal, one electrode terminal connected to the initialization voltage, and an other electrode terminal connected to the first node, a second capacitive element having one terminal connected to the first node, and a first scan transistor having a control terminal connected to the second scan signal, and one electrode terminal electrically connected to the data driver, an other electrode terminal connected to the other terminal of the second capacitive element, wherein the driving transistor may have a control terminal connected to the first node and an other electrode terminal connected to the second node and wherein the organic light emitting diode may have an anode connected to the third node and a cathode connected to a second power supply.

A magnitude of the initialization voltage may be changed when the second capacitive element is initialized.

Another embodiment of the present invention provides a driving method of a display device, including: a first step of performing a threshold voltage compensation operation of a driving transistor of a first pixel circuit; a second step of writing a corresponding data voltage in the first pixel circuit; a third step of performing a threshold voltage compensation operation of a driving transistor of a second pixel circuit; and a fourth step of writing a corresponding data voltage in the second pixel circuit, wherein the first pixel circuit and the second pixel circuit are positioned in different pixel rows and the second step and the third step at least partially overlap each other temporally.

The driving method may further include: performing an initialization operation of a capacitive element prior to the performing of the threshold voltage compensation operation.

According to an exemplary embodiment of the present invention, it is possible to provide the display device and the driving method thereof capable of sufficiently securing the threshold voltage compensation period of the driving transistor in the block driving scheme.

BRIEF DESCRIPTION OF THE DRAWINGS

FIG. 7 is a diagram illustrating mura for a compensation of the threshold voltage of the driving transistor according to one or more exemplary embodiments of the present invention.

DETAILED DESCRIPTION

Figure 1:
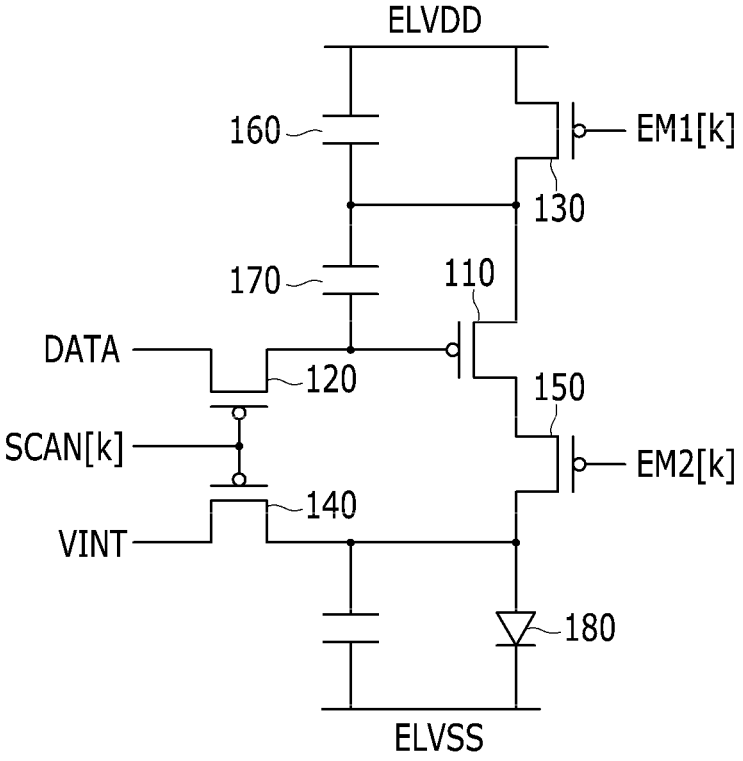
FIG. 1 is a diagram illustrating a configuration of an existing pixel circuit.

Hereinafter, exemplary embodiments of the present invention will be described with reference to the accompanying drawings. However, the detailed description of known functions or components which may obscure the disclosure of the present invention may be omitted in the following description and the accompanying drawings. Further, it is to be noted that the same components throughout the drawings are denoted by the same reference numerals when possible.

It will be understood that, although the terms "first", "second", "third", etc., may be used herein to describe various elements, components, regions, layers, and/or sections, these elements, components, regions, layers and/or sections should not be limited by these terms. These terms are only used to distinguish one element, component, region, layer or section from another element, component, region, layer or section. Thus, a first element, component, region, layer, or section discussed below could be termed a second element, component, region, layer, or section, without departing from the spirit and scope of the present invention.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

Further, it will also be understood that when one element, component, region, layer and/or section is referred to as being "between" two elements, components, regions, layers, and/or sections, it can be the only element, component, region, layer and/or section between the two elements, components, regions, layers, and/or sections, or one or more intervening elements, components, regions, layers, and/or sections may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "include," "comprises," "comprising," "includes," "including," and "include," when used in this specification, specify the presence of stated features, integers, steps, operations, elements, and/or components, but do not preclude the presence or addition of one or more other features, integers, steps, operations, elements, components, and/or groups thereof.

As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the present invention refers to "one or more embodiments of the present invention." Also, the term "exemplary" is intended to refer to an example or illustration.

It will be understood that when an element or layer is referred to as being "on," "connected to," "coupled to," "connected with," "coupled with," or "adjacent to" another element or layer, it can be "directly on," "directly connected to," "directly coupled to," "directly connected with," "directly coupled with," or "directly adjacent to" the other element or layer, or one or more intervening elements or layers may be present. When an element or layer is referred to as being "directly on," "directly connected to," "directly coupled to," "directly connected with," "directly coupled with," or "immediately adjacent to" another element or layer, there are no intervening elements or layers present.

As used herein, the term "substantially," "about," and similar terms are used as terms of approximation and not as terms of degree, and are intended to account for the inherent deviations in measured or calculated values that would be recognized by those of ordinary skill in the art.

As used herein, the terms "use," "using," and "used" may be considered synonymous with the terms "utilize," "utilizing," and "utilized," respectively.

The timing controller and/or any other relevant devices or components according to embodiments of the present invention described herein may be implemented utilizing any suitable hardware, firmware (e.g. an application-specific integrated circuit), software, or a suitable combination of software, firmware, and hardware. For example, the various components of the timing controller may be formed on one integrated circuit (IC) chip or on separate IC chips. Further, the various components of the timing controller may be implemented on a flexible printed circuit film, a tape carrier package (TCP), a printed circuit board (PCB), or formed on a same substrate as one or more circuits and/or devices of the display device. Further, the various components of the timing controller may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Terms and words used in the present specification and claims are not to be construed as a general or dictionary meaning, but are to be construed as meaning and concepts meeting the technical ideas of the present disclosure based on a principle that the present inventors may appropriately define the present invention as the concepts of terms in order to describe their disclosures in best mode. Therefore, the configurations described in the exemplary embodiments and drawings of the present invention are merely most preferable embodiments but do not represent all of the technical spirit of the present invention. Thus, the present invention should be construed as including all the changes, equivalents, and substitutions included in the spirit and scope of the present invention at the time of filing this application. Further, terms used in the 'first', 'second', etc., may be used to describe various suitable components, but are used to distinguish one component from another component and therefore are not used to limit the components.

For convenience of explanation, pixel circuits according to an exemplary embodiment of the present invention will be described under the condition that the pixel circuits correspond to each pixel of a display panel of a display device which is driven with a block unit.

All the pixel circuits corresponding to each pixel may have the same or substantially the same configuration. However, a signal line, a power supply, and a voltage which are applied to a control terminal of the pixel circuit, or the like, are never limited. The signal line, the power supply, and the voltage may be separately applied to each pixel circuit and may be commonly applied thereto. The signal line, the power supply, and the voltage may have a variable connection relationship by passing through a switching transistor, a multiplexer, and the like.

One block may include a plurality of pixel circuits which configure one line. In this case, the display device may have the same or substantially the same configuration as the display device which is driven in a line unit.

One block may include a plurality of pixel circuits which configure at least two lines.

For example, the same control signal may be concurrently applied to the plurality of pixel circuits which configure each block. However, in a data writing period, scan signals supplied to the plurality pixel rows, respectively, which configure the block are disabled at different timings to prevent or substantially prevent data from being erroneously written.

FIG. 1 is a diagram illustrating a configuration of an existing pixel circuit.

Referring to FIG. 1, the existing pixel circuit includes a first transistor 110, a second transistor 120, a third transistor 130, a fourth transistor 140, a fifth transistor 150, a first capacitive element 160, a second capacitive element 170 and an organic light emitting diode 180.

In this configuration, each transistor is a PMOS transistor.

One block includes a plurality of pixel circuits which configure n lines.

Figure 2:
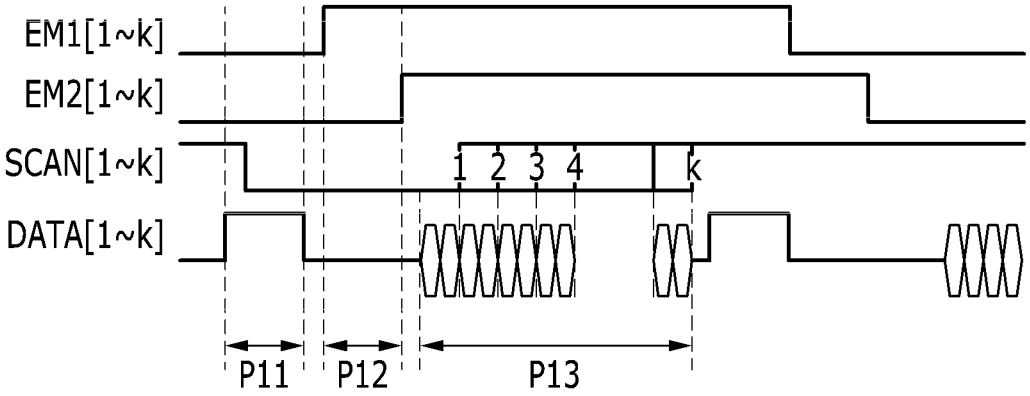
FIG. 2 is a timing diagram for describing a driving method of the pixel circuit of FIG. 1.

FIG. 2 is a timing diagram for describing a driving method of a pixel circuit of FIG. 1.

For a period P11, a first light emitting control signal EM1 is in an ON level and thus a third transistor 130 of the plurality of pixel circuits are turned on. Further, a second light emitting control signal EM2 at the ON level and thus a fifth transistor 150 of the plurality of pixel circuits are turned on. Further, a scan signal SCAN at the ON level and thus a second transistor 120 and a fourth transistor 140 of the plurality of pixel circuits are turned on. A specific reference voltage is applied to a data line.

Therefore, a parasitic capacitance component of the first capacitive element 160, the second capacitive element 170, and the organic light emitting diode 180 is initialized to a defined voltage (Cst & OLED initial).

For a period P12, the first light emitting control signal EM1 is in an OFF level and thus the third transistor 130 of the plurality of pixel circuits are turned off.

Therefore, a voltage between a control terminal 'gate' and a source electrode 'source' of the third transistor 130 is equal or substantially equal to a threshold voltage of the third transistor 130 (Vth compensation).

For a period P13, a second light emitting control signal EM2 is at an OFF level and a data voltage DATA corresponding to each line 1-n is sequentially applied. When a data voltage writing operation of a pixel circuit of a line corresponding to the applied data voltage DATA ends, a scan signal SCAN of the corresponding line is defined as the OFF level.

Therefore, as the scan signals SCAN are sequentially in the off level, the corresponding data voltage is written in the pixel circuit included in each line (DATA writing).

Next, an emission process of each pixel depending on the written data voltage DATA proceeds (Emission).

Referring to FIG. 2, the scan signals may temporally overlap each other for each pixel within one block but should be temporally spaced from a scan signal applied to another block.

When the scan signals of different blocks temporally overlap each other, an erroneous data voltage may be written in the pixel circuit in which data are written for the overlapping time.

Therefore, a temporal length of the scan signals corresponding to each block may be limited. There may be a problem in that the scan signals may not have enough time to compensate for a threshold voltage of the driving transistor.

The higher the resolution of the display device, the shorter the 1 horizontal period 1H is. As a result, a threshold voltage compensation time is short and thus mura (e.g., unevenness; irregularity; lack of uniformity; or non-uniformity) may occur on a display.

Figure 3:
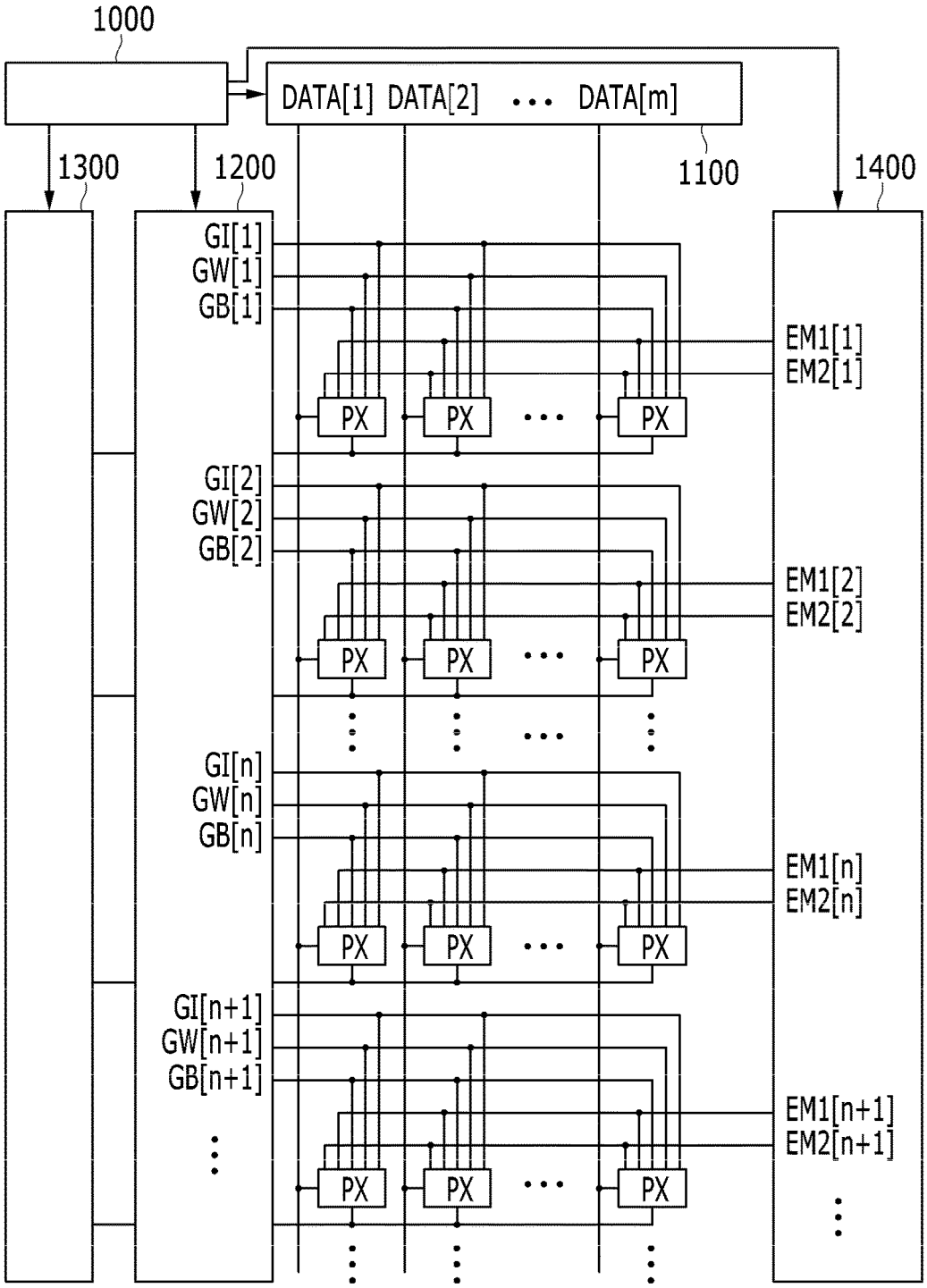
FIG. 3 is a diagram illustrating a configuration of a display device according to an exemplary embodiment of the present invention.

FIG. 3 is a diagram illustrating a configuration of a display device according to an exemplary embodiment of the present invention.

Referring to FIG. 3, the display device according to the exemplary embodiment of the present invention includes a timing controller 1000, a data driver 1100, a scan driver 1200, an initialization voltage supplier 1300, a light emitting controller 1400, and a plurality of pixel circuits.

The timing controller 1000 uses an image signal applied from the outside, a horizontal synchronization signal Hsync, a vertical synchronization signal Vsync, a clock signal, and the like to generate image data, a timing control signal, and the like for display and supply the image data and the timing control signal, and the like to the data driver 1100, the scan driver 1200, the initialization voltage supplier 1300, and the light emitting controller 1400.

The display device includes a plurality of pixel rows including a plurality of pixel circuits PXs. In other words, each pixel row includes at least two pixel circuits PXs.

The plurality of pixel rows is divided into a plurality of blocks, where each of the blocks include at least one pixel row.

According to the exemplary embodiment of the present invention of FIG. 3, a block including a pixel row of a first line to an n-th line is referred to as a first block and a block including a pixel row of an n+1-th line to a 2n-th line is referred to as a second block.

The display device according to the exemplary embodiment of the present invention may further include a third block including a pixel row of a 2n+1-th line to a 4n-th line, a fourth block including a pixel row of a 4n+1-th to a 6n-th line, which is not illustrated in the drawings due to a limited space. A relationship of the first block and the second block which is to be described below may also be applied to a relationship between two blocks with different numbers.

The scan driver 1200 supplies the scan signals to the plurality of pixel rows, respectively. For example, the same scan signal may be supplied to the plurality of pixel circuits PXs included in one line.

In the exemplary embodiment of the present invention of FIG. 3, the scan signal includes a first scan signal GI which applies an initialization voltage VINT to a control terminal of a driving transistor 410 at the ON level, a second scan signal GW which writes the data voltage DATA or a reference voltage Vref in the plurality of pixel circuits PXs at the ON level, and a third scan signal GB which applies the initialization voltage VINT to an anode of an organic light emitting diode 490 at the ON level.

Each scan signal may be supplied to the plurality of pixel circuits PXs through separate scan lines for each scan signal. Therefore, the plurality of pixel circuits PXs included in one line may each be connected to three scan lines which transfer the first scan signal G1, the second scan signal GW, and the third scan signal GB. Each set of scan lines (first, second, or third) may include a number of scan lines which corresponds to the number of pixel rows.

The first scan signal GI and the third scan signal GB may be applied to all the lines included in each block with the same or substantially the same voltage. For example, the second scan signal GW may be applied to all the lines included in each block with the same or substantially the same voltage to apply the reference voltage Vref in an initialization section, but has different timings at which each line is disabled in a data writing section (see FIGS. 5A and 5B).

Therefore, the scan line for supplying the first scan signal G1 and the scan line for supplying the third scan signal GB are present in each block (e.g., one of each per block) and each one scan line is branched to supply the first scan signal G1 and the third scan signal GB to all the pixel rows included in each block.

The data driver 1100 supplies the data voltage DATA or the reference voltage Vref to the plurality of pixel circuits PXs of the plurality of pixel rows.

In the data driver 1100, the plurality of data lines may extend to cross the scan lines. The number of data lines may equal or substantially equal to the number of pixel circuits included in one line. According to the exemplary embodiment of the present invention of FIG. 3, the number of pixel circuits included in one line is m, and therefore the number of data lines is also m.

The initialization voltage supplier 1300 supplies the initialization voltage VINT to the plurality of pixel circuits PXs. FIG. 3 illustrates that the initialization voltage supply lines extend (e.g., one initialization voltage supply line per row) in an extending direction of the scan lines for each pixel row, but the exemplary embodiment of the present invention is not limited to the configuration. According to another exemplary embodiment of the present invention, the initialization voltage supply lines may be present in each block (e.g., one initialization voltage supply line per row).

The initialization voltage supplier 1300 may be integrally formed with another voltage supplier.

When the initialization voltage is DC, the configuration of the initialization voltage supplier 1300 may be excluded from the display device.

The light emitting controller 1400 supplies the first light emitting control signal EM1 and the second light emitting control signal EM2 to the plurality of pixel circuits PXs.

For each pixel row, the signal line for supplying the first light emitting control signal EM1 and the signal line for supplying the second light emitting control signal EM2 may be connected to each other.

However, similar to the scan line, the same or substantially the same voltage signal is applied to all the pixel rows included in each block and therefore the signal line for supplying the first light emitting control signal EM1 and the signal line for supplying the second light emitting control signal EM2 may be present in each block (e.g., one of each per block). The signal line of one block is branched and thus may be connected to each pixel row of the corresponding block.

Figure 4:
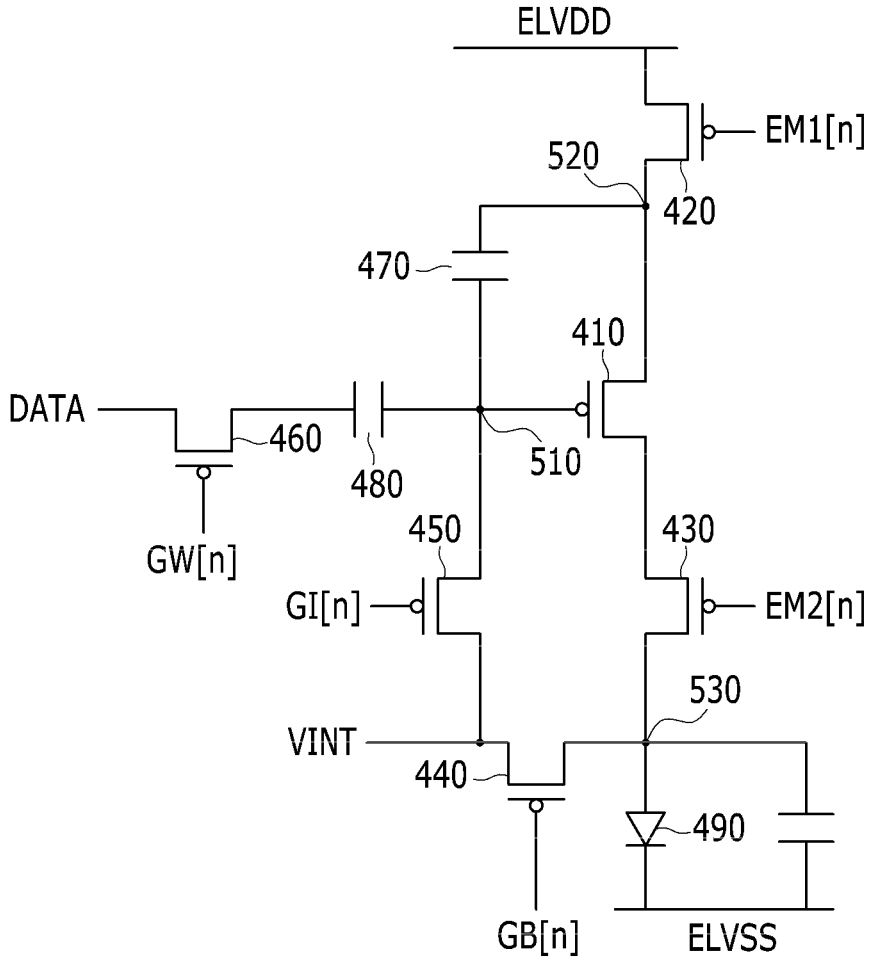
FIG. 4 is a diagram illustrating a configuration of a pixel circuit according to one or more exemplary embodiments of the present invention.

FIG. 4 is a diagram illustrating a configuration of a pixel circuit according to an exemplary embodiment of the present invention.

Referring to FIG. 4, the pixel circuit according to the exemplary embodiment of the present invention includes a driving transistor 410, a first light emitting control transistor 420, a second light emitting control transistor 430, a third scan transistor 440, a first scan transistor 450, a second scan transistor 460, a first capacitive element 470, a second capacitive element 480, and an organic light emitting diode 490.

A control terminal of the driving transistor 410 is connected to a first node 510, one electrode terminal thereof is connected to the second light emitting transistor 430, and the other electrode terminal thereof is connected to a second node 520.

One terminal of the first capacitive element 470 is connected to the first node 510 and the other terminal thereof is connected to the second node 520.

A control terminal of the first light emitting control transistor 420 is connected to the first light emitting control signal EM1, one electrode terminal thereof is connected to the second node 520, and the other electrode terminal thereof is connected to a first power supply ELVDD.

An anode of the organic light emitting diode 490 is connected to a third node 530 and a cathode thereof is connected to a second power supply ELVSS. The organic light emitting diode 490 may have a parasitic capacitance component.

A control terminal of the second light emitting control transistor 430 is connected to the second light emitting control signal, one electrode terminal thereof is connected to the other electrode terminal of the driving transistor 410, and the other electrode terminal thereof is connected to the third node 530.

A control terminal of the third scan transistor 440 is connected to the third scan signal GB, one electrode terminal thereof is connected to the third node 530, and the other electrode terminal thereof is connected to the initialization voltage VINT.

A control terminal of the first scan transistor 450 is connected to the first scan signal GI, one electrode terminal thereof is connected to the initialization voltage VINT, and the other electrode terminal thereof is connected to the first node 510.

One terminal of the second capacitive element 480 is connected to the first node 510 and the other terminal thereof is connected to the second scan transistor 460.

A control terminal of the second scan transistor 460 is connected to the second scan signal GW, one electrode terminal thereof is connected to the data line DATA, and the other electrode terminal thereof is connected to the other terminal of the second capacitive element 480.

Each transistor 410, 420, 430, 440, 450, and 460 may be a P-channel metal oxide semiconductor (PMOS) transistor.

According to another exemplary embodiment of the present invention, each transistor 410, 420, 430, 440, 450, and 460 may be an N-channel metal oxide semiconductor (NMOS) transistor or a combination of the PMOS and NMOS transistors.

Those skilled in the art may choose a type of transistor in consideration of polarity of the voltage applied to the control terminal. Therefore, the present invention is not limited by any specific type of transistor.

According to the exemplary embodiment of the present invention, the transistor includes all the switching elements (or components) which serve to electrically conduct between one electrode terminal and the other electrode terminal depending on turn on/off signals which are applied to the control terminal.

The first capacitive element 470 and the second capacitive element 480 may be capacitors.

Figure 5A:
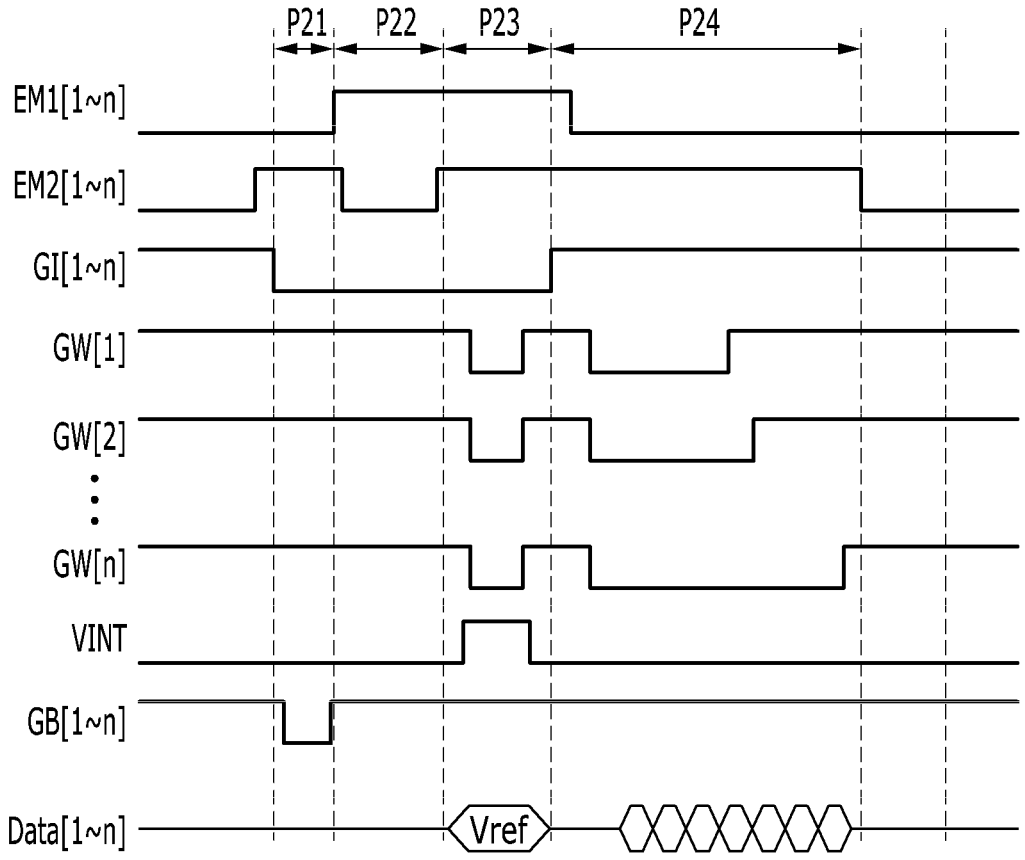
FIGS. 5A and 5B are timing diagrams for describing a driving method of a pixel circuit of FIG. 4.
Figure 5B:
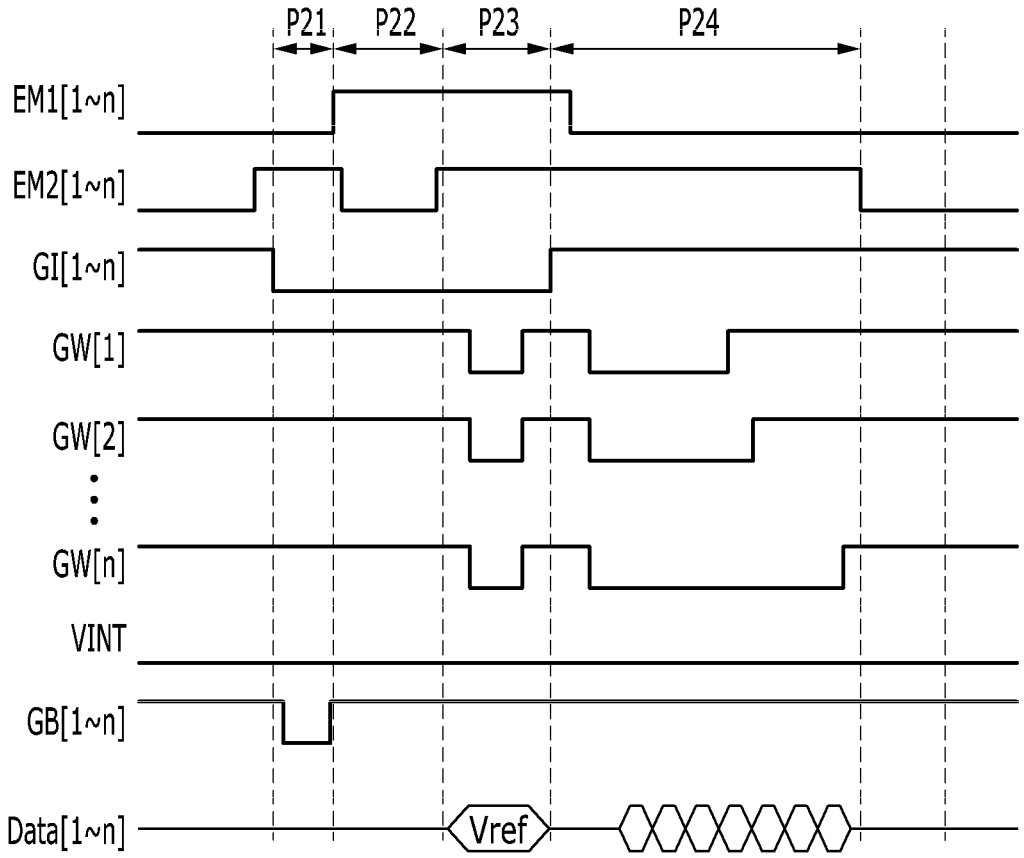

FIGS. 5A and 5B are timing diagrams for describing a driving method of a pixel circuit of FIG. 4.

FIGS. 5A and 5B are the same except for a difference in voltage applied to the initialization voltage VINT.

FIG. 5A illustrates a timing diagram of the control signal applied to the first block which includes the plurality of pixel circuits PXs included in n pixel rows.

A period P21 represents an organic light emitting diode initialization period (OLED initial), a period P22 represents a threshold voltage compensation period (Vth compensation), a period P23 represents a second capacitive element initialization period (Ccc initial), and a period P24 represents a data voltage writing period (Data writing). It should be apparent to those skilled in the art that a light emitting period after the period P24 is present.

The first light emitting control signal EM1, the second light emitting control signal EM2, the third scan signal GB, and the first scan signal GI may be commonly applied to the pixel circuit PX included in one block with the same or substantially the same magnitude of voltage at the same or substantially the same timing.

The second scan signal GW may be commonly applied to the pixel circuit PX included in one block with the same or substantially the same magnitude of voltage at the same or substantially the same timing in each step.

However, for a period P24 which is the data voltage writing period (Data writing), the timing for controlling when the second scan signal GW of the pixel circuits of each line 1-n is in an OFF level is different. When the data writing corresponding to the pixel circuits PX of each line is completed, the second scan signal GW of the pixel circuit PX of the corresponding line is applied as the OFF level to prevent or substantially prevent the data from being erroneously written.

It may be seen that during P24 of FIG. 5A that the timing when a second scan signal GW[1] applied to the pixel circuit of one line is in an OFF level is different from the timing when a second scan signal GW[n] applied to the pixel circuit of n line is in an OFF level.

An operation of the block unit including the pixel circuit of FIG. 4 will be described below with reference to FIG. 5A.

The organic light emitting diode initialization step (OLED initial) which is performed for the period P21 may be made by turning on the third scan transistor 440. That is, the organic light emitting diode initialization step (OLED initial) may be performed by making the third scan signal GB have the ON level.

According to the exemplary embodiment of the present invention of FIG. 5A, the first light emitting control signal EM1 at the ON level, the second light emitting control signal EM2 at the OFF level, the first scan signal GI at the ON level, and the second scan signal GW at the OFF level.

A voltage applied across the organic light emitting diode 490 is a difference between the voltage applied to the initialization voltage VINT and a value applied from the second power supply ELVSS and the organic light emitting diode 490 is initialized as the corresponding difference in voltage.

The voltage applied across the first capacitive element 470 is the difference between a voltage applied from the first power supply ELVDD and the voltage applied to the initialization voltage VINT and the first capacitive element 470 is initialized as the corresponding difference in voltage.

For example, the voltage applied across the first capacitive element 470 may be larger than a threshold voltage of the driving transistor 410.

The threshold voltage compensation step (Vth comp) which is performed for the period P22 may be made by turning off the first light emitting control transistor 420.

That is, the threshold voltage compensation step (Vth comp) may be performed by making the first light emitting control signal EM1 have the OFF level.

A voltage between the control terminal 'gate' and one electrode terminal 'source' of the driving transistor 410 is equal to the threshold voltage of the driving transistor 410 by a source follower scheme. That is, the threshold voltage value of the driving transistor 410 is stored in the first capacitive element 470.

According to the exemplary embodiment of the present invention of FIG. 5A, the second light emitting control signal EM2 at the ON level, the third control signal GB at the OFF level, the first scan signal GI at the ON level, and the second scan signal GW at the OFF level.

The second capacitive element initialization step (Ccc initial) which is performed for the period P23 may be performed by turning on the second scan transistor 460. That is, the second capacitive element initialization step (Ccc initial) may be performed by making the second scan signal GW have the ON level.

According to the exemplary embodiment of the present invention of FIG. 5A, the first light emitting control signal EM1 at the OFF level, the second light emitting control signal EM2 at the OFF level, the third scan signal GB at the OFF level, and the first scan signal GI at the ON level.

A voltage across the initialized second capacitive element 480 becomes a difference between the reference voltage Vref applied through the data line and the voltage supplied to the initialization voltage VINT.

Referring to FIG. 5A, the initialization voltage VINT is constantly sustained and the magnitude of voltage is changed in the period P23.

For example, a data swing range may be reduced. That is, a difference between a small voltage and a large voltage supplied from the data line may be reduced.

Generally, the data voltage DATA which is used for the data writing is a positive voltage and the initial voltage VINT is a ground voltage (GND) or a negative voltage. The magnitude of the initialization voltage VINT rises in a positive direction in the period P23 and thus the reference voltage required for the other terminal of the second capacitive element 480 also rises in a positive direction.

Therefore, the difference between the reference voltage Vref and the data voltage DATA which are supplied from the data line is reduced and therefore the required data swing range may be reduced.

However, the foregoing contents are based on the exemplary embodiment of FIG. 4 but when a kind of transistor is changed, a positive reference and a negative reference may be changed.

When the voltage supplied to the initialization voltage VINT is constantly sustained according to the exemplary embodiment of the present invention of FIG. 5B, the initialization voltage supplier 1300 may be excluded from the configuration of the display device.

The data voltage writing step (Data writing) which is performed for the period P24 may be performed by turning on the second scan transistor 460. That is, the data voltage writing step (Data writing) may be performed by making the second scan signal GW have the ON level.

According to the exemplary embodiment of the present invention of FIG. 5A, the first light emitting control signal EM1 at the ON level, the second light emitting control signal EM2 at the OFF level, the third scan signal GB at the OFF level, and the first scan signal GI at the OFF level.

The data line may supply the data voltage DATA corresponding to the pixel circuit of the corresponding row for a defined period.

The data voltage DATA is written in each capacitive element depending on a capacitance ratio of the second capacitive element 480 and the first capacitive element 470.

The first capacitive element 470 stores a sum of the threshold voltage value stored for the period P22 and the data voltage DATA value.

When the data voltage DATA is directly applied to one terminal of the first capacitive element 470 without the second capacitive element 480, the voltage across the first capacitive element 470 is the difference between the data voltage DATA and the first power supply ELVDD and the first capacitive element 470 loses the threshold voltage value which is stored in a previous step.

Therefore, the second capacitive element 480 is interposed between the second scan transistor 460 and the first capacitive element 470 and thus the problem may be prevented or substantially prevented.

As described above, when the data writing corresponding to the pixel circuits PX of each line is completed, the second scan signal GW of the pixel circuit PX of the corresponding line at the OFF level to prevent or substantially prevented the data from being erroneously written.

Figure 6:
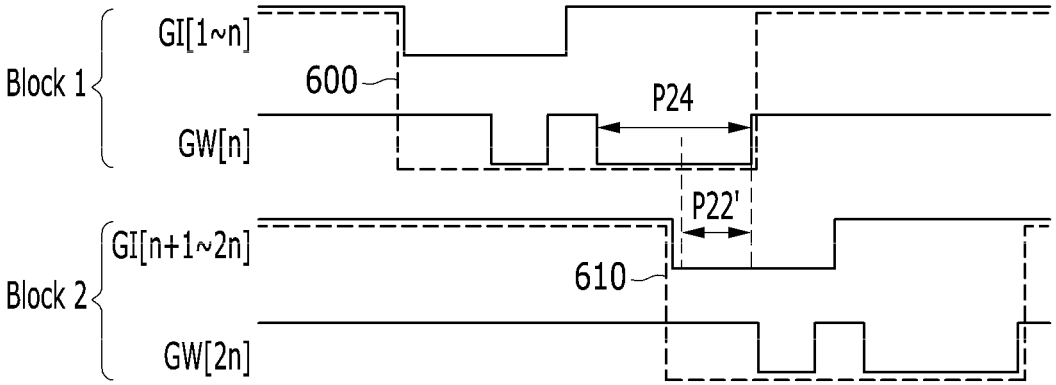
FIG. 6 is a timing diagram for describing a scan signal applied to the display device according to one or more exemplary embodiments of the present invention.

FIG. 6 is a timing diagram for describing a scan signal applied to the display device according to the exemplary embodiment of the present invention.

Referring to FIG. 6, a section from an ON level start timing of a first scan signal GI[1-n] of the first block Block 1 to an OFF level ending timing of a second scan signal GW[n] is a scan section 600 of the first block Block 1.

Further, a section from an ON level starting timing of a first scan signal GI[n+1−2n] of a second block Block 2 to an OFF level ending timing of a second scan signal GW[2n] is a scan section 610 of the second block Block 2.

The first block Block 1 and the second block Block 2 are temporally close to each other. That is, the second block Block 2 is controlled after the first block Block 1 is controlled.

Referring to FIG. 3, a pixel row n+1 subsequent to the final pixel row n in the first block Block 1 is included in the second block Block 2, and therefore the first block Block 1 is spatially close to the second block Block 2.

Generally, the scan driver 200 applies the scan signals applied in an order of a direction from the pixel row of the first line to the final pixel row, and therefore the spatial proximity may be generally a synonym of the temporal proximity.

As described above, in the existing display device of FIG. 1, the scan section 600 may overlap the scan section 610.

However, according to the exemplary embodiment of the present invention, the scan signal is controlled by dividing the first scan signal G1 and the second scan signal GW and thus the scan section 600 and the scan section 610 may partially overlap each other.

Referring to FIG. 7, the period P24 for which the data voltage DATA is written in the plurality of pixel circuits PX in the first block Block 1 and a period P22' for which the threshold voltage of the driving transistor 410 of the plurality of pixel circuits PX in the second block Block 2 is compensated partially overlap each other.

A period P21' for which the organic light emitting diode of the second block Block 2 is initialized is earlier than the period P22' and therefore may overlap the period P24.

That is, it may be represented that the period for which the data voltage DATA is supplied from the data driver 1100 and the second scan signal GW which at the ON level is applied to the plurality of pixel circuits PXs in the first block Block 1 and the period for which the first scan signal G1 which is the ON level is applied to the plurality of pixel circuits PXs of the second block Block 2 may partially overlap each other.

For example, the period does not overlap the period for which the second scan signal GW which is the ON level is applied to the plurality of pixel circuits in the second block Block 2.

When the second scan signal GW which is the ON level is concurrently (e.g., simultaneously) applied to the first block Block 1 and the second block Block 2, the erroneous writing of data may be caused.

Further, it may be represented that the period for which the data voltage DATA is supplied from the data driver 1100 and the second scan signal GW which at the ON level is applied to the plurality of pixel circuits PXs in the first block Block 1 and the period for which the third scan signal GB which is the ON level is applied to the plurality of pixel circuits PXs of the second block Block 2 may partially overlap each other.

According to the exemplary embodiment of the present invention, since the case in which the third scan signal GB at the ON level is the organic light emitting diode initialization step corresponding to the period P21, when the temporally overlapped range of the foregoing first scan signal G1 and second scan signal GW is kept, there is no problem with the operation of the display device.

FIG. 7 is a diagram illustrating mura for a compensation of the threshold voltage of the driving transistor according to some exemplary embodiments of the present invention.

As described above, an embodiment of the present invention improves the problem of the existing block driving scheme which should separate the scan section 600 of the first block from the second scan section 610 of the second block.

As the scan section 600 may overlap the scan section 610, the threshold voltage compensation period may be longer than the existing scheme, which may reduce the mura.

For example, in the case of manufacturing the panel having resolution including 2400 lines, the 1 horizontal period 1H is 1/60/2400=1.6 μs based on 60 Hz.

When the panel is driven by the existing scheme, when a separation time of each block is 0.5 μs, the turn on time of the scan signal is 6.4 μs.

However, when the panel is driven by the scheme according to the exemplary embodiment of the present invention, as an overlapped section length of a scan signal SCAN[N] and a scan signal SCAN[N+1] is defined, the on time of the scan signal may extend up to tens of μs Referring to FIG. 7, a simulation result of the mura depending on the on time of the scan signal may be confirmed. It is assumed herein that one block includes one line.

The on time of the scan signal is based on μs as a unit and a numerical value represented by avg, std, min, and max is a magnitude of current and is based on A as a unit.

The MURA is represented by a percentage value by comparing an average current with the minimum and maximum current.

It may be appreciated from the simulation result that at the time of using the existing scheme, the mura of about 20% occurs and at the time of using the scheme according to the exemplary embodiment of the present invention, when the on time of the scan signal is 11.4 μs, the mura occurs of 14% occurs and when the on time of the scan signal is 16.4 μs, the mura occurs of 12% occurs.

The accompanying drawings and the detailed description of embodiments of the present invention above are only example of embodiments of present invention, and are used to describe the present invention but are not used to limit the meaning or the scope of the present invention described in the appended claims and their equivalents. Therefore, it will be appreciated to those skilled in the art that various suitable modifications are made and other equivalent embodiments are available. Accordingly, the actual technical protection scope of the present invention must be determined by the spirit of the appended claims and their equivalents.

While this invention has been described in connection with what is presently considered to be practical exemplary embodiments, it is to be understood that the invention is not limited to the disclosed embodiments, but, on the contrary, is intended to cover various suitable modifications and equivalent arrangements included within the spirit and scope of the appended claims and their equivalents.

DESCRIPTION OF SOME OF THE SYMBOLS

410: Driving transistor
420: First light emitting control transistor
430: Second light emitting control transistor
440: Third scan transistor
450: First scan transistor
460: Second scan transistor
470: First capacitive element
480: Second capacitive element
490: Organic light emitting diode
510: First node
520: Second node
530: Third node
1000: Timing controller
1100: Data driver
1200: San driver
1300: Initialization voltage supplier
1400: Light emitting controller

What is claimed is:

1. A display device, comprising:

a plurality of pixel rows comprising a plurality of pixel circuits;

a scan driver for supplying scan signals to the plurality of pixel rows; and a data driver for supplying a data voltage or a reference voltage to the plurality of pixel circuits of the plurality of pixel rows, wherein each of the plurality of pixel circuits comprises:

a driving transistor; and an organic light emitting diode configured to emit light depending on a current flowing in the driving transistor, wherein the plurality of pixel rows are divided into a plurality of blocks, each of the blocks comprising at least one pixel row, wherein a period, for which a respective scan signal at an enable level is applied to the plurality of pixel circuits in a first block, and a period, for which a respective scan signal at an enable level is applied to the plurality of pixel circuits in a second block, partially overlap each other, and wherein a period, for which the data voltage is written in the plurality of pixel circuits in the first block among the plurality of blocks, and a period, for which a threshold voltage of the driving transistors of the plurality of pixel circuits in the second block close to the first block is compensated, partially overlap each other.

2. The display device of claim 1, wherein a period for which the data voltage is written in the plurality of pixel circuits in the first block and a period for which the organic light emitting diodes of the plurality of pixel circuits in the second block are initialized partially overlap each other.

3. The display device of claim 1, wherein the scan signal comprises:

a first scan signal for applying an initialization voltage to a control terminal of the driving transistor at an ON level; and a second scan signal for writing the data voltage or the reference voltage to the plurality of pixel circuits at the ON level.

4. A display device, comprising:

a plurality of pixel rows comprising a plurality of pixel circuits;

a scan driver for supplying scan signals to the plurality of pixel rows; and a data driver for supplying a data voltage or a reference voltage to the plurality of pixel circuits of the plurality of pixel rows, wherein each of the plurality of pixel circuits comprises:

a driving transistor; and an organic light emitting diode configured to emit light depending on a current flowing in the driving transistor, wherein the plurality of pixel rows are divided into a plurality of blocks, each of the blocks comprising at least one pixel row, wherein a period, for which the data voltage is written in the plurality of pixel circuits in a first block among the plurality of blocks, and a period, for which a threshold voltage of the driving transistors of the plurality of pixel circuits in a second block close to the first block is compensated, partially overlap each other, wherein the scan signal comprises:

a first scan signal for applying an initialization voltage to a control terminal of the driving transistor at an ON level; and a second scan signal for writing the data voltage or the reference voltage to the plurality of pixel circuits at the ON level, and wherein a period for which the data voltage is supplied from the data driver and the second scan signal which is the ON level is applied to the plurality of pixel circuits in the first block:

partially overlaps a period for which the first scan signal which is the ON level is applied to the plurality of pixel circuits in the second block; and does not overlap a period for which the second scan signal which is the ON level is applied to the plurality of pixel circuits in the second block.

5. The display device of claim 4, wherein the scan signal further comprises:

a third scan signal for applying the initialization voltage to an anode of the organic light emitting diode at the ON level.

6. The display device of claim 5, wherein the period for which the data voltage is supplied from the data driver and the second scan signal which is the ON level is applied to the plurality of pixel circuits in the first block:

partially overlaps a period for which the third scan signal which is the ON level is applied to the plurality of pixel circuits in the second block.

7. The display device of claim 5, wherein the plurality of pixel circuits each further comprises:

a first capacitive element having one terminal connected to a first node and an other terminal connected to a second node;

a first light emitting control transistor having a control terminal connected to a first light emitting control signal, one electrode terminal connected to the second node, and an other electrode terminal connected to a first power supply;

a second light emitting control transistor having a control terminal connected to a second light emitting control signal, one electrode terminal connected to one electrode terminal of the driving transistor, and an other electrode terminal connected to a third node;

a third scan transistor having a control terminal connected to a third scan signal, one electrode terminal connected to the third node, and an other electrode terminal connected to the initialization voltage;

a first scan transistor having a control terminal connected to the first scan signal, one electrode terminal connected to the initialization voltage, and an other electrode terminal connected to the first node;

a second capacitive element having one terminal connected to the first node; and a first scan transistor having a control terminal connected to the second scan signal, one electrode terminal electrically connected to the data driver, and an other electrode terminal connected to the other terminal of the second capacitive element, wherein the driving transistor has a control terminal connected to the first node and an other electrode terminal connected to the second node, and wherein the organic light emitting diode has an anode connected to the third node and a cathode connected to a second power supply.

8. The display device of claim 7, wherein a magnitude of the initialization voltage is changed when the second capacitive element is initialized.

9. A driving method of a display device, comprising:

a first step of performing a threshold voltage compensation operation of a driving transistor of a first pixel circuit;

a second step of writing a corresponding data voltage in the first pixel circuit;

a third step of performing a threshold voltage compensation operation of a driving transistor of a second pixel circuit; and a fourth step of writing a corresponding data voltage in the second pixel circuit, wherein the first step and the second step are included in a first scan period in which a scan signal of enable level is applied to a first pixel row, and the third step and the fourth step are included in a second scan period in which the scan signal of enable level is applied to a second pixel row, wherein the first scan period and the second scan period partially overlap each other, and wherein the first pixel circuit and the second pixel circuit are positioned in the first pixel rows and the second pixel rows respectively, and the second step and the third step at least partially overlap each other temporally.

10. The driving method of claim 9, further comprising:

performing an initialization operation of a capacitive element prior to the performing of the threshold voltage compensation operation.

* * * * *